United States Patent [19]

Lackner et al.

[11] Patent Number: 4,829,624

[45] Date of Patent: May 16, 1989

[54] APPARATUS FOR PRODUCING CLEANING SUDS

[75] Inventors: John R. Lackner, North Ridgeville; Stanley E. Grzywna, Elyria, both of Ohio; Thomas E. Baird, Springfield, Ill.

[73] Assignee: The Scott Fetzer Company, Cleveland, Ohio

[21] Appl. No.: 202,530

[22] Filed: Jun. 6, 1988

[51] Int. Cl.[4] ..... A47L 11/34

[52] U.S. Cl. ..... 15/320; 15/328; 239/274; 239/289; 239/346; 239/369; 261/35; 261/DIG. 26

[58] Field of Search ..... 15/320, 328; 239/274, 239/289, 343, 346, 369, 370, 372, 530; 261/35, DIG. 26

[56] References Cited

U.S. PATENT DOCUMENTS

| | | | |
|---|---|---|---|
| 1,726,741 | 9/1929 | Keller | 239/346 |
| 2,532,565 | 12/1950 | Miller | 261/DIG. 26 |
| 2,624,622 | 1/1953 | Holte | 239/343 |
| 3,392,418 | 7/1968 | Schowalter | 15/320 |
| 4,132,838 | 1/1979 | Kreuer et al. | 261/DIG. 26 |
| 4,176,421 | 12/1979 | Baird | 15/320 |
| 4,573,235 | 3/1986 | Baird et al. | 15/320 X |

FOREIGN PATENT DOCUMENTS

| | | | |
|---|---|---|---|
| 961703 | 9/1982 | U.S.S.R. | 239/343 |

*Primary Examiner*—Chris K. Moore

*Attorney, Agent, or Firm*—Pearne, Gordon, McCoy & Granger

[57] ABSTRACT

An apparatus for producing cleaning suds includes a reservoir containing a cleaning solution connected to the outlet of a vacuum cleaner or the like. The apparatus includes a flexible hose connected to the upper portion of the reservoir through which air passes from the vacuum cleaner outlet to a venturi nozzle at the remote end of the hose. An inner supply tube extends along the interior of the flexible hose and connects to the cleaning solution within the reservoir through a pressure reducing ball valve. The outlet of the supply tube is movable toward and away from the venturi to regulate the flow of the cleaning solution. Cleaning solution delivered to the venturi through the supply tube is formed into suds which are expelled onto a surface to be cleaned. The ball valve functions to reduce the pressure of the cleaning solution delivered to the venturi nozzle so that retraction of the exit end of the supply tube terminates flow of cleaning solution and also prevents siphoning thereof when the vacuum cleaner is not operated.

13 Claims, 3 Drawing Sheets

APPARATUS FOR PRODUCING CLEANING SUDS

BACKGROUND OF THE INVENTION

This invention relates generally to an apparatus for producing cleaning suds, and more particularly to a novel and improved suds producing apparatus which is adapted to be powered by a source of relatively low pressure air, and which is particularly suited for use as an attachment to a typical suction floor cleaner.

PRIOR ART

It is known to provide an attachment for vacuum or suction floor cleaners which connects to the exhaust of the cleaner and dispenses a shampoo solution as suds for shampooing rugs and the like. An example of such a device is illustrated in U.S. Pat. No. 4,176,421. Such device provides a shampoo attachment which mounts on a suction cleaner and is adapted for shampooing rugs and the like which are resting on a floor surface. The device, however, cannot be satisfactorily used to direct the suds onto furniture and other non-floor surfaces.

SUMMARY OF THE INVENTION

The present invention provides a novel and improved apparatus adapted to be connected to a source of air under pressure, such as the outlet of a suction cleaner, and to deliver suds to substantially any surface that needs to be shampooed or cleaned. For example, the apparatus can be used to deliver suds to the surfaces of furniture and drapes, as well as floor coverings.

The apparatus provides a reservoir for supply of liquid cleaning solution and a relatively long, flexible hose assembly connected at one end to the reservoir and providing a suds nozzle at the other end. When the apparatus is connected to a source of air under pressure, provided for example by the discharge of a suction floor cleaner, the cleaning solution is drawn out of the reservoir and delivered to the nozzle by the exhaust air from the floor cleaner.

The nozzle is structured to foam or suds the cleaning solution, and the suds are blown out of the nozzle onto the surface which is to be shampooed.

In the illustrated embodiment, the nozzle provides a simple venturi through which air passes. The hose assembly includes an outer hose which delivers the air to the nozzle and an inner cleaning solution supply tube through which the cleaning solution passes. The exit end of the inner supply tube is mounted for movement toward and away from the inlet of the venturi to regulate the flow of the cleaning solution.

Upstream from the exit end of the inner supply tube is a pressure reducing device which performs several functions. It ensures that the pressure of the cleaning solution at the exit end of the inner supply tube is not greater than the air pressure within the outer tube upstream from the venturi. By maintaining this pressure relationship, it is possible to shut off the flow of cleaning solution by moving the exit end of the inner supply tube to a retracted position back from the entrance of the venturi.

On the other hand, when the exit end of the inner supply tube is moved forward toward the venturi where lower air pressures exist, the pressure surrounding the exit end of the inner supply tube is lower than the pressure of the cleaning solution at that location and the cleaning solution is drawn into the nozzle where the flow of air and cleaning solution mixes to produce suds.

With this apparatus, a simple structure permits complete control of the amount of cleaning solution delivered to the nozzle without requiring metering valves or the like. This structure which does not require a metering valve is not as susceptible to valve clogging, and a very simple, reliable apparatus is provided.

The pressure reducing device also functions to prevent siphoning of cleaning solution out of the reservoir when the cleaning unit is shut off. Because the flexible hose assembly having the nozzle at its remote end can be located either above or below the level of the cleaning solution within the reservoir, the possibility of siphoning of the cleaning solution out of the reservoir to the nozzle could exist if it were not for the pressure reducing device.

In the illustrated embodiment, the pressure reducing device is provided by a simple stainless steel ball which is positioned within a cagelike structure between the reservoir per se and the inlet end of the inner supply tube. Such ball is held by gravity against a seat formed in the cage. When a sufficient pressure drop exists across the ball to overcome the weight of the ball, it is lifted away from the seat and cleaning solution is free to flow through the inner tube. However, when insufficient differential pressure exists across the ball, the ball moves into engagement with the seat and restricts flow. In effect, this simple structure automatically produces a predetermined pressure drop between the source of cleaning solution within the reservoir and the pressure of the cleaning solution flowing along the inner supply tube of the flexible tube assembly.

Further, the reservoir and the outer tube are connected to the same source of air pressure so this fixed pressure drop created in the cleaning solution flowing from the reservoir into the inner supply tube compensates for any pressure drop in the air passing along the outer tube to ensure the controlled operation described above.

These and other aspects of this invention are illustrated in the accompanying drawings, and are more fully described in the following specification.

DETAILED DESCRIPTION OF THE DRAWINGS

Figure 1:
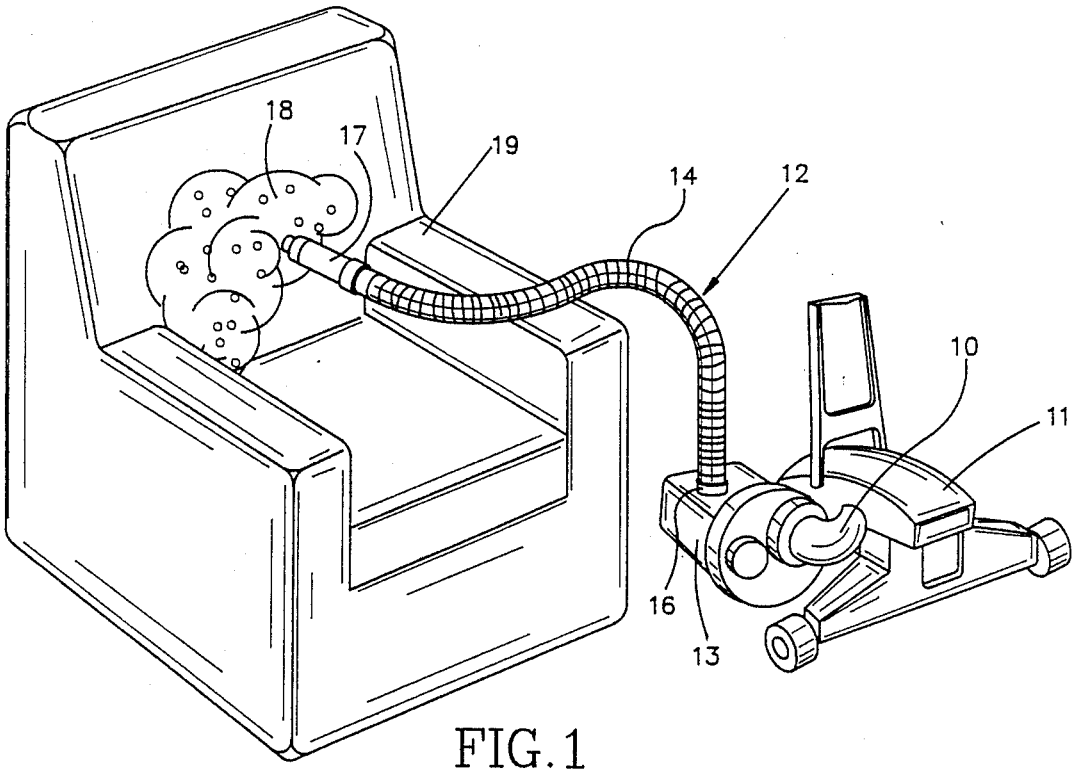
FIG. 1 is a perspective view of a sudsing apparatus in accordance with the present invention, connected to a conventional upright floor cleaner and used to deliver suds to a piece of furniture.

FIG. 1 schematically illustrates a cleaning apparatus in accordance with this invention attached to the outlet 10 of a conventional upright vacuum or suction cleaner 11. Typically, such cleaners are provided with floor nozzles through which air is drawn by a fan in the cleaner and which is discharged through the exhaust 10 to a filter bag. When such a cleaner is used with a suds producing apparatus in accordance with this invention, the filter bag is removed and the sudsing apparatus is connected to the exhaust 10. Similarly, it is preferable to remove the floor nozzle so that the flow of air through the unit is not restricted and also so that dirt is not entrained in the air.

The apparatus for producing suds is illustrated generally at 12, and includes a reservoir 13 directly connected to the exhaust 10. The sudsing apparatus 12 also includes a flexible hose assembly 14 connected at one end 16 to the reservoir and providing a suds nozzle 17 at its other end. In FIG. 1, the apparatus is illustrated in use to produce suds 18, which are deposited on an article of furniture 19 above floor level.

Figure 2:
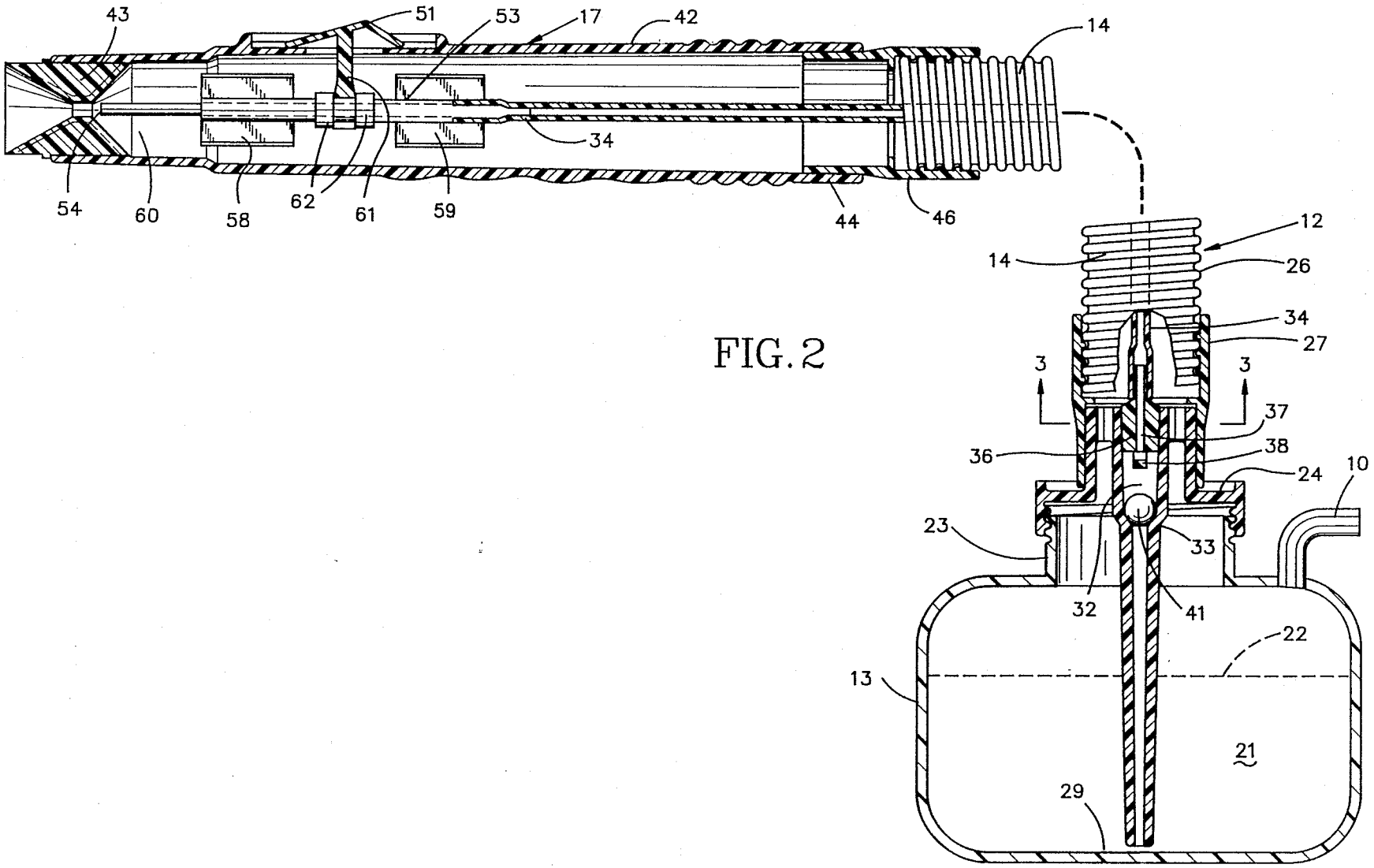
FIG. 2 is a longitudinal section of the apparatus illustrating the reservoir in phantom.

FIG. 2 illustrates the overall sudsing apparatus 12, and schematically illustrates the reservoir 13 and the exhaust 10 of the cleaner which supplies a substantial volume of exhaust air from the cleaner fan at a relatively low pressure.

Prior to operation, a liquid cleaning solution 21 is introduced into the reservoir 13. The inlet to the reservoir which is connected to the exhaust 10 is open to the reservoir above the surface 22 of the cleaning solution, and the air introduced into the reservoir functions to pressurize the liquid cleaner 21 to a pressure equal to the static pressure of the supply air.

The reservoir is provided with a threaded neck 23 through which the cleaning solution may be introduced into the reservoir and which receives a threaded tubular connector assembly 24. Such assembly is connected to one end of an outer flexible hose 26 by a mounting collar 27 and provides a tubular extension 28 which extends down into the reservoir to a position substantially adjacent to the lower wall 29 thereof and below the surface 22 of the cleaning solution 21.

Figure 3:
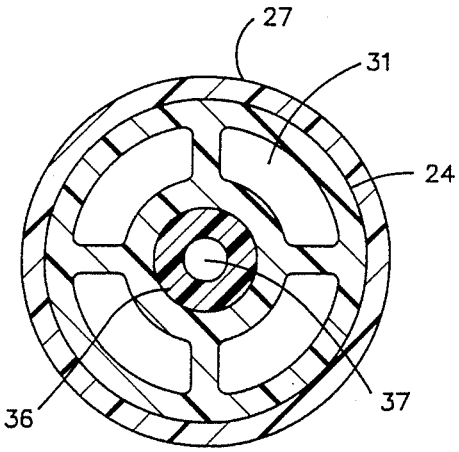
FIG. 3 is a cross section, taken along line 3—3 of FIG. 2.

As best illustrated in FIG. 3, the connector assembly 24 provides peripherally spaced openings 31 through which the air passes from the upper portion of the reservoir 13 into the adjacent end of the flexible outer hose 26, and through the outer hose to the nozzle 17.

Figure 4:
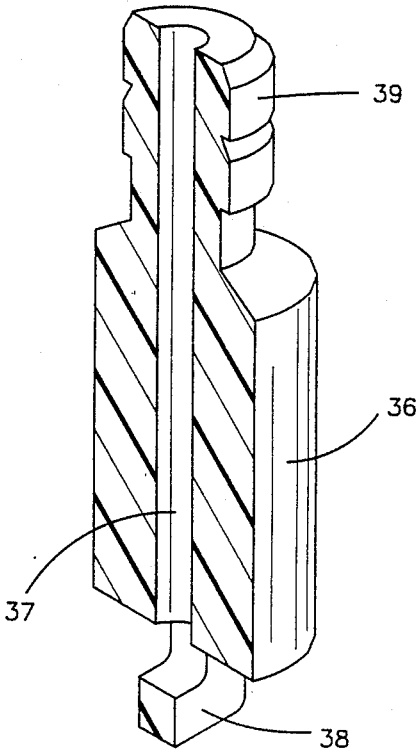
FIG. 4 is a perspective view in longitudinal section of the fitting which connects the supply of cleaning solution to the inner tube.

The upper end of the tubular portion 28 is open to an enlarged diameter chamber or cage 32 which provides a seat 33 at its lower end. The upper end of the chamber 32 is connected to an inner flexible supply tube 34 through a fitting 36 positioned in the upper end of the chamber 32. The fitting 36, as best illustrated in FIG. 4, provides a central passage 37 and a projection 38 at its lower end which extends into the chamber 32. It also provides a hose connecting portion 39 which receives the adjacent end of the flexible inner supply tube 34.

Positioned within the chamber 32 is a ball element 41 which is urged by gravity toward engagement with the seat 33, and in such position such ball closes the passage within the tubular extension 28. The ball element, as discussed in greater detail below, however, is moved from the seat 33 when sufficient pressure drop occurs across the ball so that communication is established between the inner supply tube 34 and the tubular extension 28. The extension 38 prevents the ball 41 from moving up to a position in which the passage 37 would be closed.

As mentioned previously, a nozzle 17 is mounted on the end of the flexible hose assembly 12 remote from the reservoir 13. The structure and mode of operation of the nozzle 17 can best be understood by referring to FIGS. 5 and 6. The nozzle itself includes a tubular housing 42 providing a venturi ring 43 at its outlet end and is connected to the outer hose 26 at its inlet end 44 by a coupling 46 (see FIG. 2). Preferably, the housing 42 is a molded plastic part.

The housing is also provided with generally rectangular external recess 47 providing opposed longitudinally extending grooves 48. The recess is open to the interior of the housing through a longitudinally extending opening 49. An operator 51 is positioned within the external recess 47 and provides outwardly extending flanges 52 which extend into the recesses 48 and interconnect the housing and the operator 51 to guide the operator for longitudinal movement along the housing 42.

Positioned within the interior of the nozzle and extending lengthwise along the axis thereof is a tubular member 53 which is connected to the adjacent end of the inner flexible supply tube 34 at one end and provides an exit end 54 aligned with the throat 56 of the venturi 44. The tubular member 53 is also provided with spaced sets of guide flanges 58 and 59 which extend radially at peripherally spaced locations to ensure that the tubular member 53 remains substantially centered within the housing 42 while permitting longitudinal movement of the tubular member with respect to the housing. The operator provides an inwardly projecting connecting portion 61 having an inner end which snaps around the tubular projection between a pair of shoulders 62 to connect the operator and the tubular member and permit relative axial movement.

Figure 5:
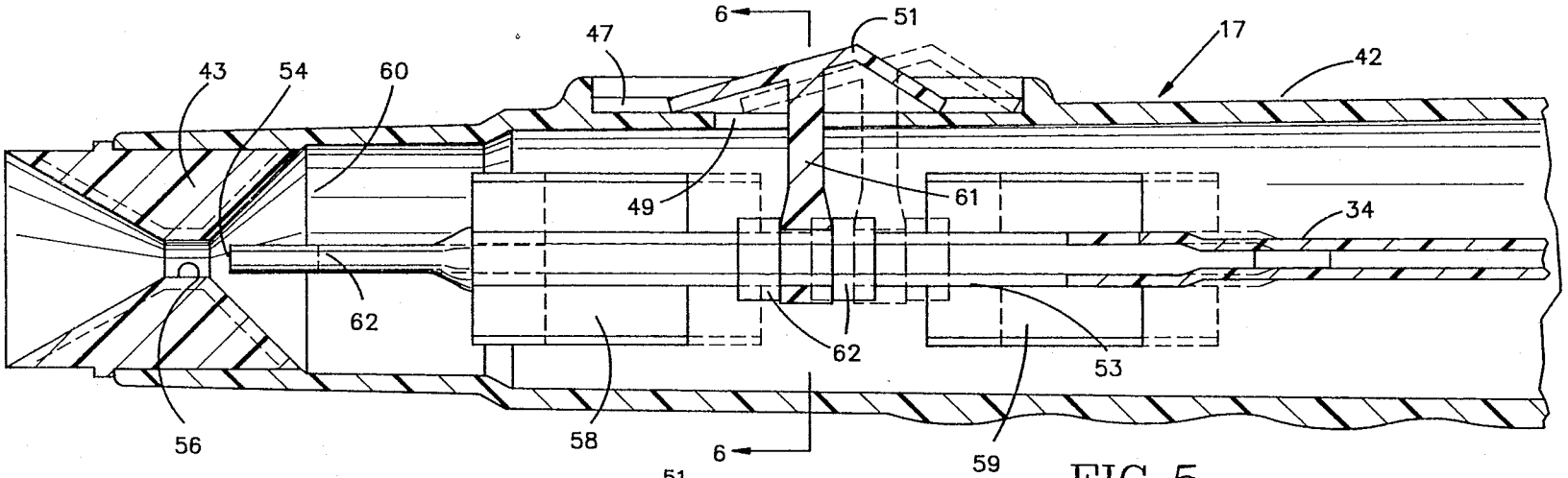
FIG. 5 is an enlarged, fragmentary section of the sudsing nozzle provided at the exit end of the flexible tube assembly.
Figure 6:
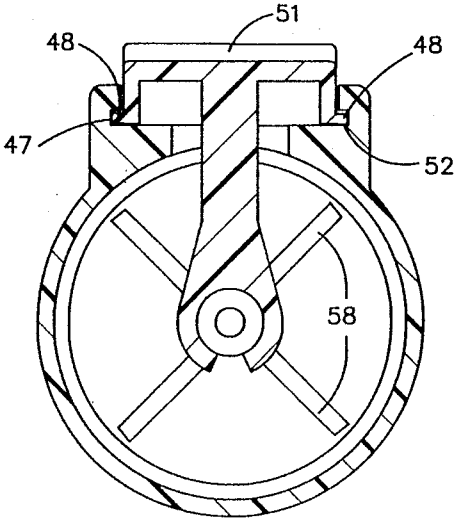
FIG. 6 is a fragmentary cross section, taken along line 6—6 of FIG. 5.

With this structure, the outlet 54 of the tubular member is movable forward and backward with respect to the venturi by merely moving the operator 51 back and forth along the external recess between a retracted position illustrated in phantom in FIG. 5 and forward positions.

OPERATION

During operation, the reservoir is mounted on the exhaust of the vacuum cleaner and is provided with a liquid cleaning solution 21. When the fan of the cleaner 11 is energized, air under pressure enters the reservoir, causing the liquid cleaner within the reservoir to be pressurized to the static pressure of the air supplied from the cleaner. The air also flows out along the zone within the outer flexible tube 26 around the inner flexible supply tube 34 to the nozzle 17. From the outer flexible hose 26, the air flows through the nozzle and through the venturi throat 56, and is discharged from the exit end of the venturi 43.

The pressure of the air at the zone 60, immediately ahead of the venturi 43, approaches the pressure of the air within the reservoir and differs therefrom only due to the resistance to flow of the air as it passes through the outer flexible hose 26. If the exit end 54 of the tubular member is retracted to a position illustrated in phantom at 62, the air pressure in the zone 60 surrounding such exit end 54 closely approaches the pressure within the reservoir. In such position, the cleaning solution is not drawn out of the reservoir because the weight of the ball 41 maintains the ball in engagement with the seat 33, isolating the inner supply tube 34 from the liquid cleaner 21.

As the air passes from the zone 60 into the venturi and moves toward the throat 56, the pressure of the air reduces progressively and the pressure of the air in the throat is substantially less than the pressure of the air at the inlet zone 60. When it is desired to produce suds, the user merely moves the operator 51 forward, causing the exit end 54 of the tubular member 53 to be moved progressively toward the throat 56 of the venturi 43. As this is done, the pressure at the exit end 54 is progressively reduced, creating differential pressure across the ball 41. When sufficient differential pressure exists, the ball 41 is lifted away from the seat 33, providing communication between the exit end 54 and the liquid cleaner, and liquid cleaner is drawn out of the reservoir and passes along the inner supply tube 34 to the exit end, where it is mixed with the air flowing through the venturi and is converted into suds. The suds are then expelled from the nozzle by the flow of the air and deposited on the surface which is to be cleaned.

The rate of flow of the liquid cleaner, and consequently the amount of suds produced, is controlled by moving the operator 51 back and forth to vary the amount of differential pressure between the pressure of the liquid cleaner within the reservoir and the pressure at the exit end 54. The user merely pushes the operator 51 forward if a greater amount of suds is required, and retracts it back when a lesser amount or no suds are required.

With this very simple structure, it is therefore possible to regulate the amount of suds that issues from the nozzle, and if the nozzle is raised to a higher elevation in which the weight of the liquid cleaner flowing along the inner supply tube 34 establishes a greater hydrostatic pressure resisting flow of the liquid, it is merely necessary to move the operator 51 forward a small amount to again achieve the desired flow rate of the suds production. Similarly, if the nozzle is moved to a lower position in which the hydrostatic pressure of the liquid cleaner is reduced, causing increased cleaning solution flow, it is merely necessary for the user to move the operator 51 back slightly to maintain the desired rate of flow. With this structure, the user can establish substantially any desired rate of suds production.

The ball 41 is sized and formed of a material having sufficient weight so that movement of the operator 51 to the fully retracted position causes the ball to be moved by gravity into engagement with the seat so that all flow of the liquid cleaner is terminated, even when the air continues to flow through the outer flexible hose.

The ball element 41 also functions to prevent siphoning of the liquid cleaner when the cleaner 11 is turned off and the nozzle is placed on the floor, for example, where the nozzle is below the level of the liquid cleaner within the reservoir. Although the ball can be formed of various materials, it has been found that a stainless steel ball operates to provide sufficient pressure drop to prevent both siphoning when the cleaner 11 is shut off and flow when the operator 51 is fully retracted.

Although it is illustrated that the flexible inner supply hose 34 extends along the central axis of the exterior hose, in practice it lies along the lower side of such hose. The inner hose is sufficiently flexible and sufficiently long so that the movement of the tubular member 53 is not restricted except by the structure of the nozzle itself.

With this invention, a very simple, reliable structure is provided which can be used with a typical vacuum or suction cleaner to produce suds and to permit the direction of the suds to substantially any surface which must be cleaned. Not only is this structure easily manufactured at low cost, but also the tendency for the apparatus to be clogged is virtually eliminated.

Although the preferred embodiment of this invention has been shown and described, it should be understood that various modifications and rearrangements of the parts may be resorted to without departing from the scope of the invention as disclosed and claimed herein.

What is claimed is:

1. A vacuum cleaner and cleaning suds accessory comprising a vacuum cleaner having an inlet and an outlet through which air is discharged, an apparatus for producing cleaning suds, a reservoir connected to said outlet, a liquid cleaning solution in said reservoir, a flexible hose assembly having an inlet connected to said reservoir above said cleaning solution and an outlet providing a venturi having an upstream side, a supply tube having an inlet immersed in said cleaning solution in said reservoir and an outlet adjacent to said upstream side of said venturi, air from said outlet operating to pressurize said cleaning solution to a predetermined pressure and also causing air to flow along said hose to said upstream side of said venturi, and a pressure reducer operable to reduce the pressure of said cleaning solution at said outlet of said supply tube to a pressure less than the air pressure in said hose upstream from said venturi and greater than the pressure of said air within said venturi, air under pressure flowing through said venturi operating to draw cleaning solution from said outlet of said tube and to carry said cleaning solution through said venturi causing said cleaning solution to emerge from said venturi as cleaning suds, said outlet of said tube being movable toward and away from said venturi to regulate the flow of cleaning solution entering said venturi.

2. An apparatus for producing cleaning suds comprising a reservoir for a supply of cleaning solution, a flexible hose assembly having an outlet providing a venturi having an upstream side, a cleaning solution supply tube having an inlet adapted to be immersed in said cleaning solution in said reservoir and an outlet adjacent to said upstream side of said venturi, said reservoir being adapted to be connected to a source of air under a predetermined pressure to pressurize said cleaning solution to said predetermined pressure, said hose also being adapted to be connected to said source to cause air to flow from said upstream side through said venturi, and a pressure reducer connected between the ends of said supply tube operable to reduce the pressure of said cleaning solution to a pressure less than the air pressure in said hose upstream from said venturi and greater than the pressure of said air within said venturi, air under pressure flowing through said venturi being operable to draw cleaning solution from said outlet of said tube and carry said cleaning solution through said venturi causing said cleaning solution to emerge from said venturi as a cleaning suds, said outlet of said supply tube being movable toward and away from said venturi to regulate the flow of cleaning solution entering said venturi.

3. An apparatus as set forth in claim 2, wherein said pressure reducer operates to prevent siphoning of said cleaning solution through said supply tube when said source is not supplying air under pressure.

4. An apparatus as set forth in claim 2, wherein said pressure reducer reduces the pressure of said cleaning solution at the outlet of said supply tube a sufficient amount to prevent flow of said cleannig solution when said outlet of said supply tube is moved away from said venturi.

5. An apparatus as set forth in claim 2, wherein said pressure reducer produces a substantially constant pressure drop in said cleaning solution as said cleaning solution passes from said inlet to said outlet of said supply tube.

6. An apparatus as set forth in claim 5, wherein said pressure reducer is a valve member past which said cleaning solution flows as it passes from said inlet to said outlet of said supply tube, said pressure drop being a function of the weight of said valve member.

7. An apparatus as set forth in claim 6, wherein said valve member is a ball urged by gravity toward a valve seat and moved from said valve seat to permit flow through said supply tube by the difference in pressure between said inlet and said outlet of said supply tube.

8. An apparatus as set forth in claim 2, wherein said supply tube extends along the interior of said flexible tube, and said flexible hose provides an inlet connected to said reservoir.

9. An apparatus as set forth in claim 8, wherein said reservoir is adapted to be connected to the exhaust of a suction floor cleaner.

10. An apparatus for producing cleaning suds comprising a reservoir, a liquid cleaning solution in said reservoir, a flexible hose assembly having an outlet providing a venturi having an upstream side, a supply tube having an inlet immersed in said cleaning solution in said reservoir and an outlet adjacent to said upstream side of said venturi, a source of air under a predetermined pressure connected to said reservoir operating to pressurize said cleaning solution to said predetermined pressure, said source of air also being connected to said hose to cause air to flow from said upstream side through said venturi, and a pressure reducer operable to reduce the pressure of said cleaning solution at said outlet of said supply tube to a pressure less than the air pressure in said hose upstream from said venturi and greater than the pressure of said air within said venturi, air under pressure flowing through said venturi operating to draw cleaning solution from said outlet of said tube and to carry said cleaning solution through said venturi causing said cleaning solution to emerge from said venturi as cleaning suds, said outlet of said tube being movable toward and away from said venturi to regulate the flow of cleaning solution entering said venturi.

11. An aparatus as set forth in claim 10. wherein said source of air under pressure is a suction floor cleaner providing an exhaust connected to said reservoir and said flexible hose.

12. An apparatus as set forth in claim 11, wherein said flexible hose provides an inlet connected to said reservoir above said cleaning solution and said supply tube includes a flexible tube extending along the interior of said flexible hose.

13. An apparatus as set forth in claim 12, wherein said flexible hose assembly includes a nozzle providing said venturi, said nozzle also providing an external operator connected to said supply tube for moving said outlet of said supply tube toward and away from said venturi.

* * * * *